US010678170B2

(12) United States Patent
Ishigaya et al.

(10) Patent No.: US 10,678,170 B2
(45) **Date of Patent: *Jun. 9, 2020**

(54) FIXING DEVICE AND IMAGE FORMING APPARATUS

(71) Applicant: Ricoh Company, Ltd., Tokyo (JP)

(72) Inventors: Yasunori Ishigaya, Kanagawa (JP); Kazuya Saito, Kanagawa (JP); Keitaro Shoji, Kanagawa (JP); Toshihiko Shimokawa, Kanagawa (JP); Hiromasa Takagi, Tokyo (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/185,091

(22) Filed: Nov. 9, 2018

(65) Prior Publication Data

US 2019/0094764 A1 Mar. 28, 2019

Related U.S. Application Data

(63) Continuation of application No. 15/410,179, filed on Jan. 19, 2017, now Pat. No. 10,156,818.

(30) Foreign Application Priority Data

Feb. 25, 2016 (JP) ..... 2016-034117

(51) Int. Cl.
*G03G 15/20* (2006.01)

(52) U.S. Cl.
CPC ..... *G03G 15/2007* (2013.01); *G03G 15/2042* (2013.01); *G03G 15/2053* (2013.01)

(58) Field of Classification Search
None
See application file for complete search history.

(56) References Cited

U.S. PATENT DOCUMENTS 6,442,360 B1 8/2002 Onodera et al.
2004/0002698 A1 1/2004 Hua Xiao
(Continued)

FOREIGN PATENT DOCUMENTS

JP 4-044083 2/1992
JP 2001-143520 A 5/2001
(Continued)

OTHER PUBLICATIONS

Office Action dated Jan. 7, 2020 (Dispatch No. 003196), issued in corresponding Japanese Patent Application No. 2016-034117, 2 pages.

(Continued)

*Primary Examiner* — Victor Verbitsky
(74) *Attorney, Agent, or Firm* — Xsensus LLP

(57) ABSTRACT

A fixing device includes a fixing rotator being rotatable and a heater to heat the fixing rotator. The heater includes a tube, a heat generator, disposed inside the tube, to generate heat, and a sealing portion, disposed at each lateral end of the tube in a longitudinal direction of the heater, to seal the tube. A reflector reflects heat radiated from the heater toward the fixing rotator. The reflector includes an outboard edge being disposed inboard from at least a part of the sealing portion in an axial direction of the fixing rotator.

5 Claims, 8 Drawing Sheets

(56) References Cited

U.S. PATENT DOCUMENTS

| | | | | |
|---|---|---|---|---|
| 2005/0158066 | A1 | 7/2005 | Tomiyori | |
| 2007/0292175 | A1 | 12/2007 | Shinshi | |
| 2011/0164905 | A1* | 7/2011 | Kondo | G03G 15/2053 399/328 |
| 2011/0211876 | A1 | 9/2011 | Iwaya et al. | |
| 2013/0136515 | A1 | 5/2013 | Sahara | |
| 2013/0183071 | A1 | 7/2013 | Iwaya et al. | |
| 2013/0183072 | A1 | 7/2013 | Hase | |
| 2013/0209147 | A1 | 8/2013 | Ogawa et al. | |
| 2014/0072355 | A1 | 3/2014 | Tamaki et al. | |
| 2014/0079453 | A1 | 3/2014 | Arai et al. | |
| 2014/0270831 | A1 | 9/2014 | Yoshinaga et al. | |
| 2014/0270832 | A1 | 9/2014 | Saito et al. | |
| 2014/0270833 | A1 | 9/2014 | Yuasa et al. | |
| 2014/0286684 | A1 | 9/2014 | Takagi et al. | |
| 2014/0341623 | A1 | 11/2014 | Arai et al. | |
| 2014/0341624 | A1 | 11/2014 | Arai et al. | |
| 2014/0341627 | A1 | 11/2014 | Yoshikawa et al. | |
| 2014/0356038 | A1 | 12/2014 | Arai et al. | |
| 2015/0055993 | A1 | 2/2015 | Shoji | |
| 2015/0063884 | A1 | 3/2015 | Iwaya et al. | |
| 2015/0098738 | A1 | 4/2015 | Arai et al. | |
| 2015/0268597 | A1 | 9/2015 | Arai et al. | |
| 2016/0327890 | A1 | 11/2016 | Shiki | |
| 2016/0378027 | A1 | 12/2016 | Sawada et al. | |
| 2017/0010570 | A1 | 1/2017 | Fujimoto et al. | |

FOREIGN PATENT DOCUMENTS

| | | | |
|---|---|---|---|
| JP | 2002-258646 | A | 9/2002 |
| JP | 2004-286922 | | 10/2004 |
| JP | 2007-334205 | | 12/2007 |
| JP | 2009-295462 | A | 12/2009 |
| JP | 2010-026256 | | 2/2010 |
| JP | 2010-032625 | | 2/2010 |
| JP | 2010-107720 | A | 5/2010 |
| JP | 2011-180220 | | 9/2011 |
| JP | 2013-164473 | A | 8/2013 |
| JP | 2014-164045 | | 9/2014 |
| JP | 2014-186211 | | 10/2014 |
| JP | 2014-222316 | | 11/2014 |
| JP | 2014-240952 | A | 12/2014 |
| JP | 2015-064560 | | 4/2015 |
| JP | 2015-079083 | | 4/2015 |
| JP | 2015-194634 | | 11/2015 |

OTHER PUBLICATIONS

Office Action dated Oct. 17, 2019 (Dispatch No. 436415), issued in corresponding Japanese Patent Application No. 2016-034117, 4 pages.

* cited by examiner

FIXING DEVICE AND IMAGE FORMING APPARATUS

CROSS-REFERENCE TO RELATED APPLICATION

This patent application is a continuation of and claims priority to U.S. Ser. No. 15/410,179, filed on Jan. 19, 2017, which is based on and claims priority pursuant to 35 U.S.C. § 119 to Japanese Patent Application No. 2016-034117, filed on Feb. 25, 2016, in the Japanese Patent Office. The entire contents of each of the above applications are hereby incorporated by reference herein in entirety.

BACKGROUND

Technical Field

Exemplary aspects of the present disclosure relate to a fixing device and an image forming apparatus, and more particularly, to a fixing device for fixing a toner image on a recording medium and an image forming apparatus incorporating the fixing device.

Description of the Background

Related-art image forming apparatuses, such as copiers, facsimile machines, printers, or multifunction printers having two or more of copying, printing, scanning, facsimile, plotter, and other functions, typically form an image on a recording medium according to image data. Thus, for example, a charger uniformly charges a surface of a photoconductor; an optical writer emits a light beam onto the charged surface of the photoconductor to form an electrostatic latent image on the photoconductor according to the image data; a developing device supplies toner to the electrostatic latent image formed on the photoconductor to render the electrostatic latent image visible as a toner image; the toner image is directly transferred from the photoconductor onto a recording medium or is indirectly transferred from the photoconductor onto a recording medium via an intermediate transfer belt; finally, a fixing device applies heat and pressure to the recording medium bearing the toner image to fix the toner image on the recording medium, thus forming the image on the recording medium.

Such fixing device may include a fixing rotator, such as a fixing roller, a fixing belt, and a fixing film, heated by a heater and an opposed rotator, such as a pressure roller and a pressure belt, pressed against the fixing rotator to form a fixing nip therebetween through which a recording medium bearing a toner image is conveyed. As the recording medium bearing the toner image is conveyed through the fixing nip, the fixing rotator and the opposed rotator apply heat and pressure to the recording medium, melting and fixing the toner image on the recording medium.

SUMMARY

This specification describes below an improved fixing device. In one exemplary embodiment, the fixing device includes a fixing rotator being rotatable and a heater to heat the fixing rotator. The heater includes a tube, a heat generator, disposed inside the tube, to generate heat, and a sealing portion, disposed at each lateral end of the tube in a longitudinal direction of the heater, to seal the tube. The sealing portion includes an inboard edge. A reflector reflects heat radiated from the heater toward the fixing rotator. The reflector includes an outboard edge being disposed inboard from the inboard edge of the sealing portion in an axial direction of the fixing rotator.

This specification further describes an improved image forming apparatus. In one exemplary embodiment, the image forming apparatus includes an image forming device to form a toner image and a fixing device disposed downstream from the image forming device in a recording medium conveyance direction to fix the toner image on a recording medium. The fixing device includes a fixing rotator being rotatable and a heater to heat the fixing rotator. The heater includes a tube, a heat generator, disposed inside the tube, to generate heat, and a sealing portion, disposed at each lateral end of the tube in a longitudinal direction of the heater, to seal the tube. The sealing portion includes an inboard edge. A reflector reflects heat radiated from the heater toward the fixing rotator. The reflector includes an outboard edge being disposed inboard from the inboard edge of the sealing portion in an axial direction of the fixing rotator.

BRIEF DESCRIPTION OF THE DRAWINGS

A more complete appreciation of the embodiments and many of the attendant advantages and features thereof can be readily obtained and understood from the following detailed description with reference to the accompanying drawings, wherein.

Figure 1:
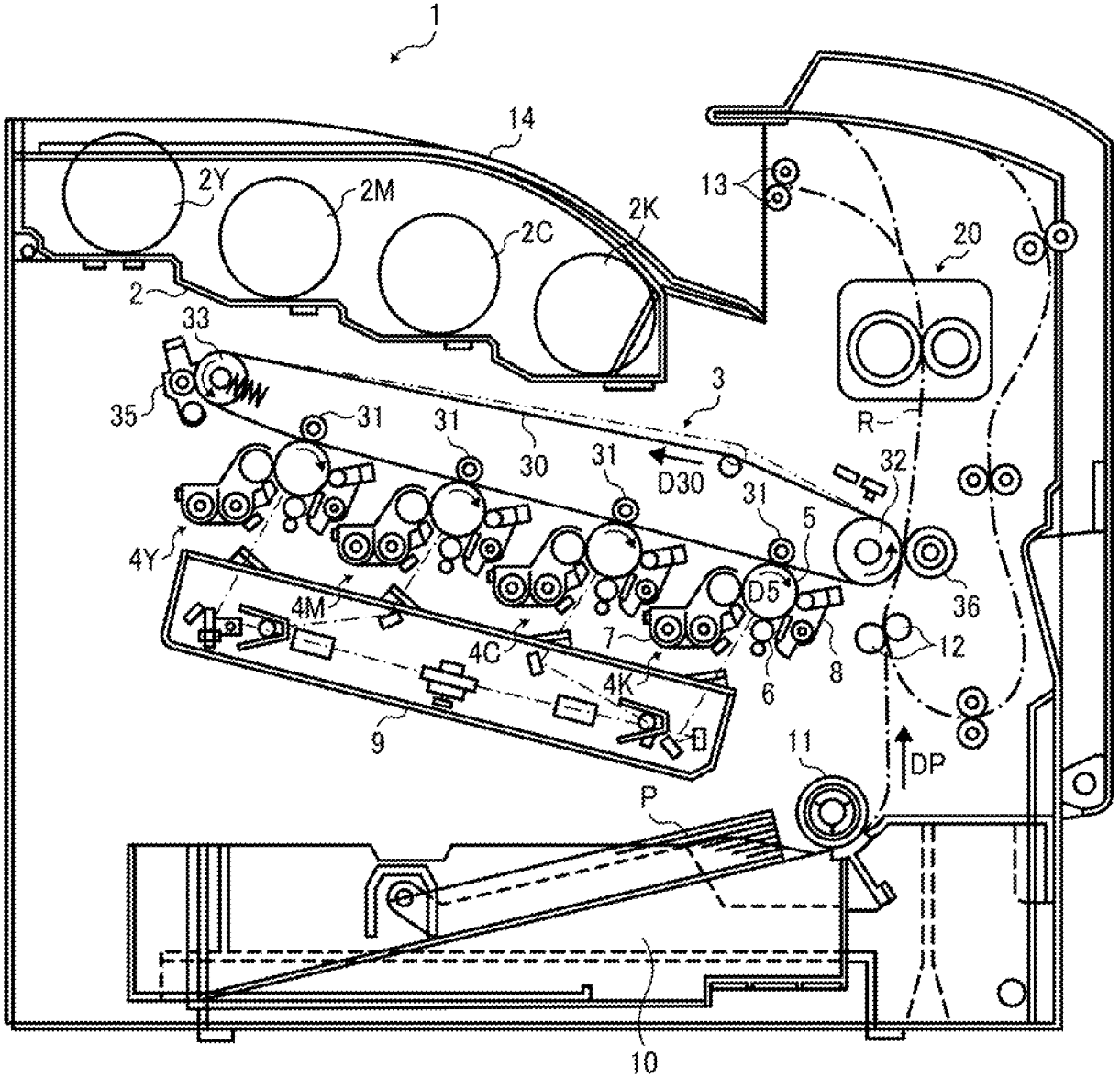
FIG. 1 is a schematic vertical cross-sectional view of an image forming apparatus according to an exemplary embodiment of the present disclosure.

The accompanying drawings are intended to depict embodiments of the present disclosure and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION OF THE DISCLOSURE

In describing embodiments illustrated in the drawings, specific terminology is employed for the sake of clarity.

However, the disclosure of this specification is not intended to be limited to the specific terminology so selected and it is to be understood that each specific element includes all technical equivalents that have a similar function, operate in a similar manner, and achieve a similar result.

As used herein, the singular forms "a", "an", and "the" are intended to include the plural forms as well, unless the context clearly indicates otherwise.

Referring now to the drawings, wherein like reference numerals designate identical or corresponding parts throughout the several views, particularly to FIG. 1, an image forming apparatus 1 according to an exemplary embodiment is explained.

FIG. 1 is a schematic vertical cross-sectional view of the image forming apparatus 1. The image forming apparatus 1 may be a copier, a facsimile machine, a printer, a multifunction peripheral or a multifunction printer (MFP) having at least one of copying, printing, scanning, facsimile, and plotter functions, or the like. According to this exemplary embodiment, the image forming apparatus 1 is a color printer that forms color and monochrome toner images on a recording medium by electrophotography. Alternatively, the image forming apparatus 1 may be a monochrome printer that forms a monochrome toner image on a recording medium.

In the drawings for explaining exemplary embodiments of this disclosure, identical reference numerals are assigned as long as discrimination is possible to components such as members and component parts having an identical function or shape, thus omitting a description thereof once the description is provided.

Referring to FIG. 1, a description is provided of a construction of the image forming apparatus 1.

As illustrated in FIG. 1, the image forming apparatus 1 is a color laser printer including four image forming devices 4Y, 4M, 4C, and 4K situated in a center portion thereof. Although the image forming devices 4Y, 4M, 4C, and 4K contain developers (e.g., yellow, magenta, cyan, and black toners) in different colors, that is, yellow, magenta, cyan, and black corresponding to color separation components of a color image, respectively, the image forming devices 4Y, 4M, 4C, and 4K have an identical structure.

For example, each of the image forming devices 4Y, 4M, 4C, and 4K includes a drum-shaped photoconductor 5 serving as an image bearer or a latent image bearer that bears an electrostatic latent image and a resultant toner image; a charger 6 that charges an outer circumferential surface of the photoconductor 5; a developing device 7 that supplies toner to the electrostatic latent image formed on the outer circumferential surface of the photoconductor 5, thus visualizing the electrostatic latent image as a toner image; and a cleaner 8 that cleans the outer circumferential surface of the photoconductor 5. FIG. 1 illustrates reference numerals assigned to the photoconductor 5, the charger 6, the developing device 7, and the cleaner 8 of the image forming device 4K that forms a black toner image. However, reference numerals for the image forming devices 4Y, 4M, and 4C that form yellow, magenta, and cyan toner images, respectively, are omitted.

Below the image forming devices 4Y, 4M, 4C, and 4K is an exposure device 9 that exposes the outer circumferential surface of the respective photoconductors 5 with laser beams. For example, the exposure device 9, constructed of a light source, a polygon mirror, an f-θ lens, reflection mirrors, and the like, emits a laser beam onto the outer circumferential surface of the respective photoconductors 5 according to image data sent from an external device such as a client computer.

Above the image forming devices 4Y, 4M, 4C, and 4K is a transfer device 3. For example, the transfer device 3 includes an intermediate transfer belt 30 serving as an intermediate transferor, four primary transfer rollers 31 serving as primary transferors, a secondary transfer roller 36 serving as a secondary transferor, a driving roller 32, a driven roller 33, and a belt cleaner 35.

The intermediate transfer belt 30 is an endless belt stretched taut across the driving roller 32 and the driven roller 33. As a driver drives and rotates the driving roller 32 counterclockwise in FIG. 1, the driving roller 32 rotates the intermediate transfer belt 30 counterclockwise in FIG. 1 in a rotation direction D30 by friction therebetween.

The four primary transfer rollers 31 sandwich the intermediate transfer belt 30 together with the four photoconductors 5, forming four primary transfer nips between the intermediate transfer belt 30 and the photoconductors 5, respectively. The primary transfer rollers 31 are coupled to a power supply that applies at least one of a predetermined direct current (DC) voltage and a predetermined alternating current (AC) voltage thereto.

The secondary transfer roller 36 sandwiches the intermediate transfer belt 30 together with the driving roller 32, forming a secondary transfer nip between the secondary transfer roller 36 and the intermediate transfer belt 30. Similar to the primary transfer rollers 31, the secondary transfer roller 36 is coupled to the power supply that applies at least one of a predetermined direct current (DC) voltage and a predetermined alternating current (AC) voltage thereto.

The belt cleaner 35 includes a cleaning brush and a cleaning blade that contact an outer circumferential surface of the intermediate transfer belt 30. A waste toner drain tube extending from the belt cleaner 35 to an inlet of a waste toner container conveys waste toner collected from the intermediate transfer belt 30 by the belt cleaner 35 to the waste toner container.

A bottle holder 2 situated in an upper portion of the image forming apparatus 1 accommodates four toner bottles 2Y, 2M, 2C, and 2K detachably attached to the bottle holder 2. The toner bottles 2Y, 2M, 2C, and 2K contain fresh yellow, magenta, cyan, and black toners to be supplied to the developing devices 7 of the image forming devices 4Y, 4M, 4C, and 4K, respectively. For example, the fresh yellow, magenta, cyan, and black toners are supplied from the toner bottles 2Y, 2M, 2C, and 2K to the developing devices 7 through toner supply tubes interposed between the toner bottles 2Y, 2M, 2C, and 2K and the developing devices 7, respectively.

In a lower portion of the image forming apparatus 1 are a paper tray 10 that loads a plurality of sheets P serving as recording media and a feed roller 11 that picks up and feeds a sheet P from the paper tray 10 toward the secondary transfer nip formed between the secondary transfer roller 36 and the intermediate transfer belt 30. The sheets P may be thick paper, postcards, envelopes, plain paper, thin paper, coated paper, art paper, tracing paper, overhead projector (OHP) transparencies, and the like. Optionally, a bypass tray that loads thick paper, postcards, envelopes, thin paper, coated paper, art paper, tracing paper, OHP transparencies, and the like may be attached to the image forming apparatus 1.

A conveyance path R extends from the feed roller 11 to an output roller pair 13 to convey the sheet P picked up from the paper tray 10 onto an outside of the image forming apparatus 1 through the secondary transfer nip. The conveyance path R is provided with a registration roller pair 12 located below the secondary transfer nip formed between the secondary transfer roller 36 and the intermediate transfer belt 30, that is, upstream from the secondary transfer nip in a sheet conveyance direction DP. The registration roller pair 12 serving as a timing roller pair conveys the sheet P conveyed from the feed roller 11 toward the secondary transfer nip at a proper time.

The conveyance path R is further provided with a fixing device 20 (e.g., a fuser or a fusing unit) located above the secondary transfer nip, that is, downstream from the secondary transfer nip in the sheet conveyance direction DP. The fixing device 20 fixes an unfixed toner image transferred from the intermediate transfer belt 30 onto the sheet P conveyed from the secondary transfer nip on the sheet P. The conveyance path R is further provided with the output roller pair 13 located above the fixing device 20, that is, downstream from the fixing device 20 in the sheet conveyance direction DP. The output roller pair 13 ejects the sheet P bearing the fixed toner image onto the outside of the image forming apparatus 1, that is, an output tray 14 disposed atop the image forming apparatus 1. The output tray 14 stocks the sheet P ejected by the output roller pair 13.

Referring to FIG. 1, a description is provided of an image forming operation performed by the image forming apparatus 1 having the construction described above to form a full color toner image on a sheet P.

As a print job starts, a driver drives and rotates the photoconductors 5 of the image forming devices 4Y, 4M, 4C, and 4K, respectively, clockwise in FIG. 1 in a rotation direction D5. The chargers 6 uniformly charge the outer circumferential surface of the respective photoconductors 5 at a predetermined polarity. The exposure device 9 emits laser beams onto the charged outer circumferential surface of the respective photoconductors 5 according to yellow, magenta, cyan, and black image data constructing color image data sent from the external device, respectively, thus forming electrostatic latent images on the photoconductors 5. The image data used to expose the respective photoconductors 5 is monochrome image data produced by decomposing a desired full color image into yellow, magenta, cyan, and black image data. The developing devices 7 supply yellow, magenta, cyan, and black toners to the electrostatic latent images formed on the photoconductors 5, visualizing the electrostatic latent images as yellow, magenta, cyan, and black toner images, respectively.

Simultaneously, as the print job starts, the driving roller 32 is driven and rotated counterclockwise in FIG. 1, rotating the intermediate transfer belt 30 in the rotation direction D30 by friction therebetween. The power supply applies a constant voltage or a constant current control voltage having a polarity opposite a polarity of the charged toner to the primary transfer rollers 31, creating a transfer electric field at the respective primary transfer nips formed between the photoconductors 5 and the primary transfer rollers 31.

When the yellow, magenta, cyan, and black toner images formed on the photoconductors 5 reach the primary transfer nips, respectively, in accordance with rotation of the photoconductors 5, the yellow, magenta, cyan, and black toner images are primarily transferred from the photoconductors 5 onto the intermediate transfer belt 30 by the transfer electric field created at the primary transfer nips such that the yellow, magenta, cyan, and black toner images are superimposed successively on a same position on the intermediate transfer belt 30. Thus, a full color toner image is formed on the outer circumferential surface of the intermediate transfer belt 30. After the primary transfer of the yellow, magenta, cyan, and black toner images from the photoconductors 5 onto the intermediate transfer belt 30, the cleaners 8 remove residual toner failed to be transferred onto the intermediate transfer belt 30 and therefore remaining on the photoconductors 5 therefrom, respectively. Thereafter, dischargers discharge the outer circumferential surface of the respective photoconductors 5, initializing the surface potential thereof.

On the other hand, the feed roller 11 disposed in the lower portion of the image forming apparatus 1 is driven and rotated to feed a sheet P from the paper tray 10 toward the registration roller pair 12 through the conveyance path R. The registration roller pair 12 temporarily halts the sheet P conveyed through the conveyance path R.

Thereafter, the registration roller pair 12 resumes rotation at a predetermined time to convey the sheet P to the secondary transfer nip at a time when the full color toner image formed on intermediate transfer belt 30 reaches the secondary transfer nip. The secondary transfer roller 36 is applied with a transfer voltage having a polarity opposite a polarity of the charged yellow, magenta, cyan, and black toners constructing the full color toner image formed on the intermediate transfer belt 30, thus creating a transfer electric field at the secondary transfer nip. The transfer electric field secondarily transfers the yellow, magenta, cyan, and black toner images constructing the full color toner image formed on the intermediate transfer belt 30 onto the sheet P collectively. After the secondary transfer of the full color toner image from the intermediate transfer belt 30 onto the sheet P, the belt cleaner 35 removes residual toner failed to be transferred onto the sheet P and therefore remaining on the intermediate transfer belt 30 therefrom. The removed toner is conveyed and collected into the waste toner container.

Thereafter, the sheet P bearing the full color toner image is conveyed to the fixing device 20 that fixes the full color toner image on the sheet P. Then, the sheet P bearing the fixed full color toner image is ejected by the output roller pair 13 onto the outside of the image forming apparatus 1, that is, the output tray 14 that stocks the sheet P.

The above describes the image forming operation of the image forming apparatus 1 to form the full color toner image on the sheet P. Alternatively, the image forming apparatus 1 may form a monochrome toner image by using any one of the four image forming devices 4Y, 4M, 4C, and 4K or may form a bicolor toner image or a tricolor toner image by using two or three of the image forming devices 4Y, 4M, 4C, and 4K.

Figure 2:
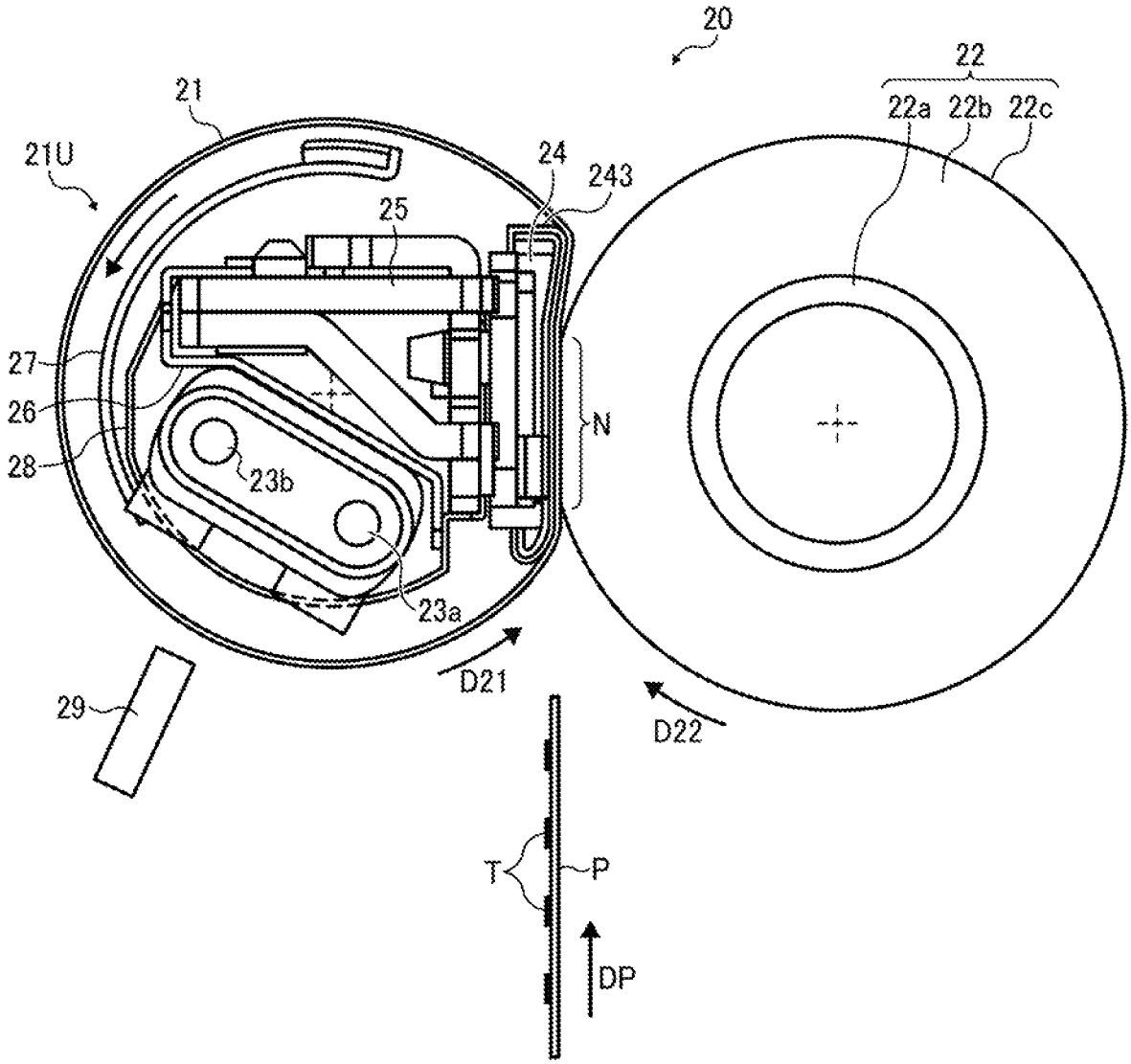
FIG. 2 is a vertical cross-sectional view of a fixing device according to a first exemplary embodiment, which is incorporated in the image forming apparatus depicted in FIG. 1.

Referring to FIG. 2, a description is provided of a construction of the fixing device 20 incorporated in the image forming apparatus 1 having the construction described above.

FIG. 2 is a schematic vertical cross-sectional view of the fixing device 20. As illustrated in FIG. 2, the fixing device 20 (e.g., a fuser or a fusing unit) includes a fixing belt 21, a pressure roller 22, two halogen heaters 23*a* and 23*b*, a nip formation pad 24, a stay 25, a reflector 26, a movable shield 27, a stationary shield 28, and a temperature sensor 29.

The fixing belt 21 formed into a loop serves as a fixing rotator or a fixing member rotatable in a rotation direction D21. The pressure roller 22 serves as an opposed rotator or a pressure rotator that is rotatable in a rotation direction D22 and disposed opposite an outer circumferential surface of the fixing belt 21. The two halogen heaters 23*a* and 23*b* serve as a heater or a heat source that heats the fixing belt 21. The nip formation pad 24 is disposed opposite an inner circumferential surface of the fixing belt 21. The stay 25 serves as a support that supports the nip formation pad 24. The reflector 26 reflects light or heat (e.g., radiant heat) radiated from the halogen heaters 23*a* and 23*b* toward the fixing belt 21. The movable shield 27 shields the fixing belt 21 from light or heat radiated from at least one of the halogen heaters 23*a* and 23*b* to the fixing belt 21. According to this exemplary embodiment, the movable shield 27 shields the fixing belt 21 from light or heat radiated from the halogen heater 23*b* mainly. The stationary shield 28 serves as a lateral end shield that shields the fixing belt 21 from light or heat radiated from the halogen heaters 23*a* and 23*b* to the fixing belt 21. The temperature sensor 29 serves as a temperature detector that detects the temperature of the outer circumferential surface of the fixing belt 21.

The fixing belt 21 and the components disposed inside the loop formed by the fixing belt 21, that is, the halogen heaters 23*a* and 23*b*, the nip formation pad 24, the stay 25, the reflector 26, the movable shield 27, and the stationary shield 28, may construct a belt unit 21U separably coupled with the pressure roller 22.

A detailed description is now given of a construction of the fixing belt 21.

The fixing belt 21 is a thin, flexible endless belt or film. For example, the fixing belt 21 is constructed of a base layer serving as the inner circumferential surface of the fixing belt 21 and a release layer serving as the outer circumferential surface of the fixing belt 21. The base layer is made of metal such as nickel and SUS stainless steel or resin such as polyimide (PI). The release layer is made of tetrafluoroethylene-perfluoroalkylvinylether copolymer (PFA), polytetrafluoroethylene (PTFE), or the like. Optionally, an elastic layer made of rubber such as silicone rubber, silicone rubber foam, and fluoro rubber may be interposed between the base layer and the release layer.

If the fixing belt 21 does not incorporate the elastic layer, the fixing belt 21 has a decreased thermal capacity that improves fixing property of being heated quickly to a predetermined fixing temperature at which a toner image T is fixed on a sheet P. However, as the pressure roller 22 and the fixing belt 21 sandwich and press the unfixed toner image T on the sheet P passing through the fixing nip N, slight surface asperities of the fixing belt 21 may be transferred onto the toner image T on the sheet P, resulting in variation in gloss of the solid toner image T. To address this circumstance, the fixing belt 21 incorporates the elastic layer having a thickness not smaller than 100 micrometers. The elastic layer having the thickness not smaller than 100 micrometers elastically deforms to absorb slight surface asperities of the fixing belt 21, preventing variation in gloss of the toner image T on the sheet P.

In order to decrease the thermal capacity of the fixing belt 21, the fixing belt 21 is thin and has a decreased loop diameter. For example, the fixing belt 21 is constructed of the base layer having a thickness in a range of from 20 micrometers to 50 micrometers; the elastic layer having a thickness in a range of from 100 micrometers to 300 micrometers; and the release layer having a thickness in a range of from 10 micrometers to 50 micrometers. Thus, the fixing belt 21 has a total thickness not greater than 1 mm. A loop diameter of the fixing belt 21 is in a range of from 20 mm to 40 mm. In order to decrease the thermal capacity of the fixing belt 21 further, the fixing belt 21 may have a total thickness not greater than 0.20 mm and preferably not greater than 0.16 mm.

A detailed description is now given of a construction of the pressure roller 22.

The pressure roller 22 is constructed of a core bar 22*a*; an elastic layer 22*b* coating the core bar 22*a* and made of rubber such as silicone rubber foam, silicone rubber, and fluoro rubber; and a release layer 22*c* coating the elastic layer 22*b* and made of PFA, PTFE, or the like. A pressurization assembly presses the pressure roller 22 against the nip formation pad 24 via the fixing belt 21. The pressure roller 22 pressingly contacting the fixing belt 21 deforms the elastic layer 22*b* of the pressure roller 22 at a fixing nip N formed between the pressure roller 22 and the fixing belt 21, thus defining the fixing nip N having a predetermined length in the sheet conveyance direction DP.

A driver (e.g., a motor) disposed inside the image forming apparatus 1 depicted in FIG. 1 drives and rotates the pressure roller 22. As the driver drives and rotates the pressure roller 22, a driving force of the driver is transmitted from the pressure roller 22 to the fixing belt 21 at the fixing nip N, thus rotating the fixing belt 21 in accordance with rotation of the pressure roller 22 by friction between the pressure roller 22 and the fixing belt 21. Alternatively, the driver may also be connected to the fixing belt 21 to drive and rotate the fixing belt 21.

According to this exemplary embodiment, the pressure roller 22 is a solid roller. Alternatively, the pressure roller 22 may be a hollow roller. In this case, a heater such as a halogen heater may be disposed inside the hollow roller. The elastic layer 22*b* may be made of solid rubber. Alternatively, if no heater is situated inside the pressure roller 22, the elastic layer 22*b* may be made of sponge rubber. The sponge rubber is more preferable than the solid rubber because the sponge rubber has an increased insulation that draws less heat from the fixing belt 21.

A detailed description is now given of a configuration of the halogen heaters 23*a* and 23*b*.

The halogen heaters 23*a* and 23*b* are disposed opposite the inner circumferential surface of the fixing belt 21. The halogen heaters 23*a* and 23*b* heat a heating span of the fixing belt 21 directly. The heating span is other than or disposed outboard from the fixing nip N in a circumferential direction, that is, the rotation direction D21, of the fixing belt 21. According to this exemplary embodiment, the heating span of the fixing belt 21 is a direct heating span of the fixing belt 21 that is disposed upstream from the fixing nip N in the rotation direction D21 of the fixing belt 21 or the sheet conveyance direction DP. The halogen heaters 23*a* and 23*b* are disposed opposite the direct heating span of the fixing belt 21 directly to heat the fixing belt 21 directly.

The power supply situated inside the image forming apparatus 1 supplies power to the halogen heaters 23*a* and 23*b* so that the halogen heaters 23*a* and 23*b* heat the fixing belt 21. A controller (e.g., a processor), that is, a central processing unit (CPU) provided with a random-access memory (RAM) and a read-only memory (ROM), for example, operatively connected to the halogen heaters 23*a* and 23*b* and the temperature sensor 29 controls the halogen heaters 23*a* and 23*b* based on the temperature of the outer circumferential surface of the fixing belt 21 that is detected by the temperature sensor 29. Thus, the controller adjusts the temperature of the fixing belt 21 to a desired fixing temperature. Instead of the temperature sensor 29 that detects the temperature of the fixing belt 21, a temperature sensor that detects the temperature of the pressure roller 22 may be disposed opposite the pressure roller 22 so that the temperature of the fixing belt 21 is estimated based on a temperature of the pressure roller 22 that is detected by the temperature sensor.

When the fixing device 20 receives a fixing job to fix an unfixed toner image T on a sheet P, the driver drives and rotates the pressure roller 22 which in turn rotates the fixing belt 21 by friction therebetween. One or both of the halogen heaters 23*a* and 23*b* generate heat that heats the fixing belt 21. When the temperature of the fixing belt 21 reaches the desired fixing temperature, the sheet P is conveyed through the fixing nip N. While the sheet P is conveyed through the fixing nip N, the fixing belt 21 and the pressure roller 22 fix the toner image T on the sheet P under heat and pressure.

A detailed description is now given of a construction of the nip formation pad 24.

The nip formation pad 24 is disposed inside the loop formed by the fixing belt 21 and disposed opposite the pressure roller 22 via the fixing belt 21. The stay 25 supports the nip formation pad 24. Accordingly, even if the nip formation pad 24 receives pressure from the pressure roller 22, the nip formation pad 24 is not bent by the pressure and therefore produces a uniform nip length of the fixing nip N in the sheet conveyance direction DP throughout the entire width of the fixing belt 21 and the pressure roller 22 in an axial direction thereof.

The stay 25 is made of metal having an increased mechanical strength, such as steel (e.g., stainless steel), to prevent bending of the nip formation pad 24. Alternatively, the stay 25 may be made of resin having a mechanical strength great enough to prevent bending of the nip formation pad 24.

For example, the nip formation pad 24 is made of heat resistant resin such as polyether sulfone (PES), polyphenylene sulfide (PPS), liquid crystal polymer (LCP), polyether nitrile (PEN), polyamide imide (PAI), polyether ether ketone (PEEK), or the like.

A nip side face of the nip formation pad 24 that faces the fixing nip N is attached with a low-friction sheet 243. As the fixing belt 21 rotates in the rotation direction D21, the inner circumferential surface of the fixing belt 21 slides over the low-friction sheet 243 that reduces friction between the fixing belt 21 and the nip formation pad 24. Alternatively, the low-friction sheet 243 may be omitted.

A detailed description is now given of a configuration of the reflector 26.

The reflector 26 is interposed between the stay 25 and the halogen heaters 23*a* and 23*b*. The reflector 26 is secured to and supported by the stay 25. The reflector 26 reflects heat or light radiated from the halogen heaters 23*a* and 23*b* toward the fixing belt 21, suppressing conduction of heat from the halogen heaters 23*a* and 23*b* to the stay 25 and the like and thereby heating the fixing belt 21 effectively and saving energy. The reflector 26 is made of aluminum, stainless steel, or the like. If the reflector 26 is constructed of an aluminum base treated with vapor deposition of silver having a decreased emissivity and an increased reflectance, the reflector 26 enhances heating efficiency in heating the fixing belt 21.

A detailed description is now given of a configuration of the movable shield 27 and the stationary shield 28.

The movable shield 27 is manufactured by contouring a metal plate having a thickness in a range of from 0.1 mm to 1.0 mm into an arch in cross-section along the inner circumferential surface of the fixing belt 21. The movable shield 27 is interposed between the halogen heaters 23*a* and 23*b* and the fixing belt 21 and movable in the circumferential direction of the fixing belt 21. Conversely, the stationary shield 28 is secured to the stay 25. The stationary shield 28 is disposed opposite the inner circumferential surface of the fixing belt 21 at each lateral end of the fixing belt 21 in the axial direction thereof. The stationary shield 28 is disposed opposite the halogen heaters 23*a* and 23*b* to shield the fixing belt 21 from the halogen heaters 23*a* and 23*b*. Since the movable shield 27 and the stationary shield 28 are requested to be heat resistant, the movable shield 27 and the stationary shield 28 are made of metal such as aluminum, iron, and stainless steel or ceramics.

Figure 3:
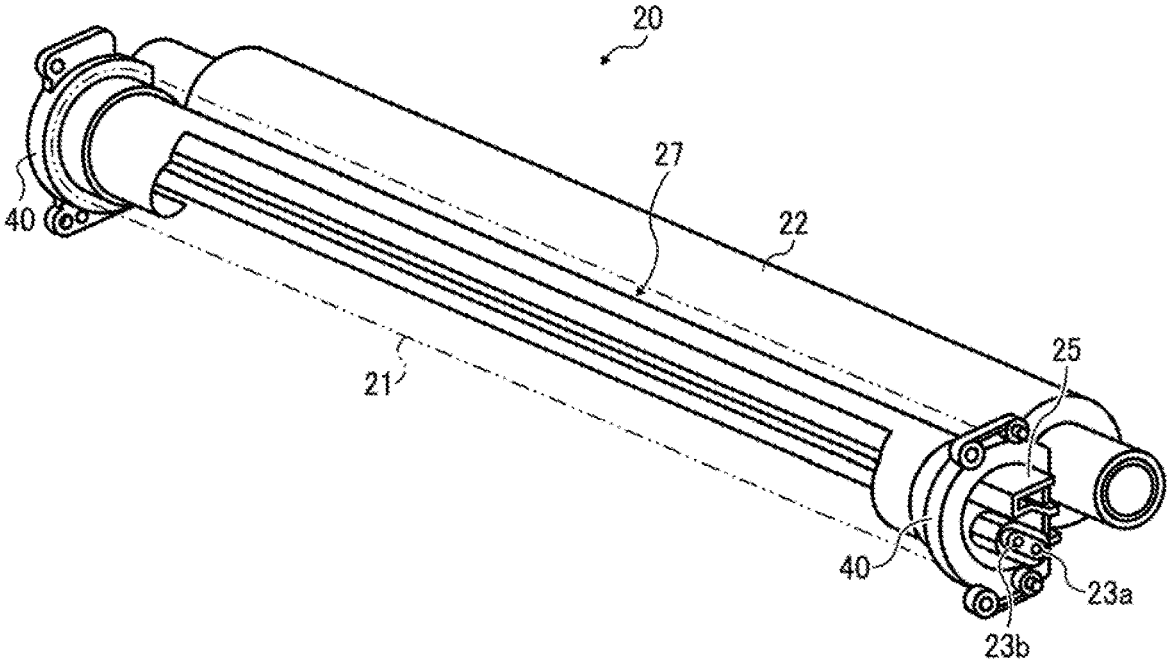
FIG. 3 is a partial perspective view of the fixing device depicted in FIG. 2, illustrating main components of the fixing device.

FIG. 3 is a partial perspective view of the fixing device 20, illustrating main components of the fixing device 20.

A description is provided of a configuration of a plurality of belt holders 40.

As illustrated in FIG. 3, the fixing device 20 further includes the plurality of belt holders 40 serving as holders disposed opposite the inner circumferential surface of the fixing belt 21 at both lateral ends of the fixing belt 21 in the axial direction thereof, respectively. The belt holders 40 are inserted into the loop formed by the fixing belt 21. The belt holders 40 rotatably support the fixing belt 21 at both lateral ends of the fixing belt 21 in the axial direction thereof. Basically, no other component supports the fixing belt 21. That is, the fixing belt 21 is not looped over or stretched taut across rollers or the like. The pair of belt holders 40, the halogen heaters 23*a* and 23*b*, and the stay 25 are secured to and supported by a pair of side plates of the fixing device 20 that is disposed at both lateral ends of the fixing device 20 in the axial direction of the fixing belt 21, respectively.

Figure 4:
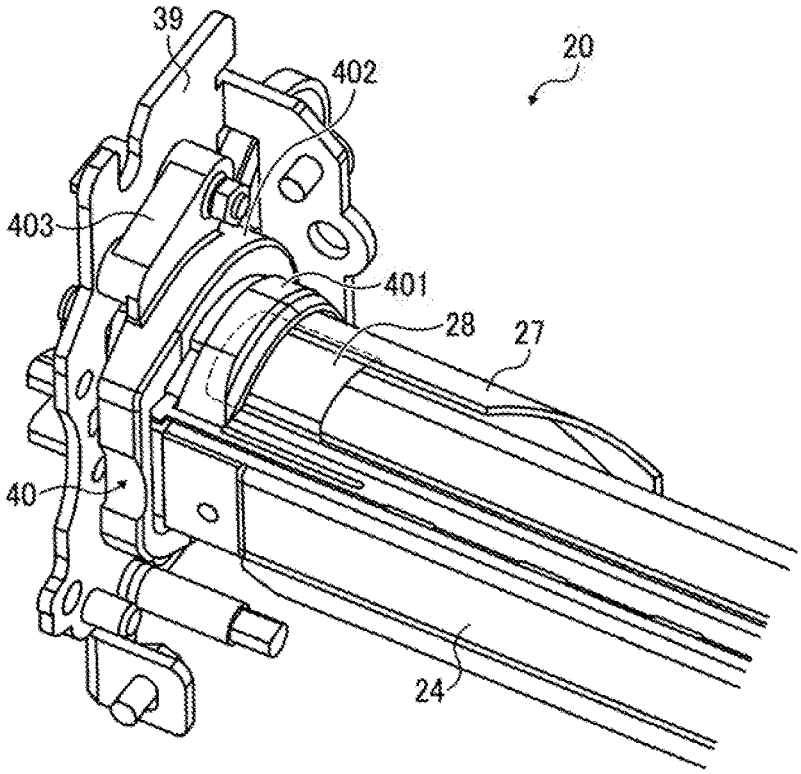
FIG. 4 is a partial perspective view of the fixing device depicted in FIG. 2, illustrating one lateral end of the fixing device in a longitudinal direction thereof, where a belt holder is situated.
Figure 5:
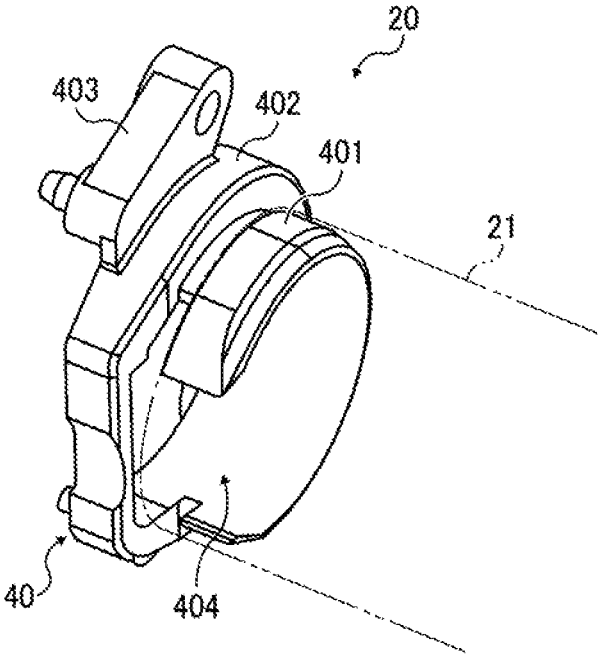
FIG. 5 is a perspective view of the belt holder depicted in FIG. 4.

FIG. 4 is a partial perspective view of the fixing device 20, illustrating one lateral end of the fixing device 20 in a longitudinal direction thereof, where the belt holder 40 is situated. FIG. 5 is a perspective view of the belt holder 40.

As illustrated in FIGS. 4 and 5, the belt holder 40 includes a holding portion 401, a restricting portion 402, a mounted portion 403, and a slit 404. As illustrated in FIG. 5, the holding portion 401 is disposed inside the loop formed by the fixing belt 21 to rotatably support the fixing belt 21. The restricting portion 402 restricts skew of the fixing belt 21 in the axial direction thereof. As illustrated in FIG. 4, the mounted portion 403 is mounted on and secured to a side plate 39 of the fixing device 20 with a fastener such as a screw. As illustrated in FIG. 5, the holding portion 401 is provided with the slit 404 at a part of the holding portion 401 in the circumferential direction of the fixing belt 21 and is partially cylindrical or tubular. As the holding portion 401 is inserted into an interior inside the loop formed by the fixing belt 21 at each lateral end of the fixing belt 21 in the axial direction thereof, the holding portion 401 rotatably supports the fixing belt 21.

After the fixing device 20 is assembled, each lateral end of the nip formation pad 24 in a longitudinal direction thereof is disposed in the slit 404 of the holding portion 401. As illustrated in FIG. 4, the stationary shield 28 is disposed opposite an inner circumferential surface of the holding portion 401. The stationary shield 28 shields the belt holder 40 from the halogen heaters 23*a* and 23*b*, preventing the belt holder 40 from being overheated by the halogen heaters 23*a* and 23*b* and thereby preventing the belt holder 40 from being deformed thermally and broken.

As illustrated in FIG. 5, the restricting portion 402 is greater than at least an outer loop diameter of the fixing belt 21. The restricting portion 402 is disposed opposite a lateral edge face of the fixing belt 21 in the axial direction thereof. If the fixing belt 21 is skewed in the axial direction thereof while the fixing belt 21 rotates, the lateral edge face of the fixing belt 21 comes into contact with the restricting portion 402 which restricts skew of the fixing belt 21.

A description is provided of a construction of the halogen heaters 23*a* and 23*b*.

Figure 6:
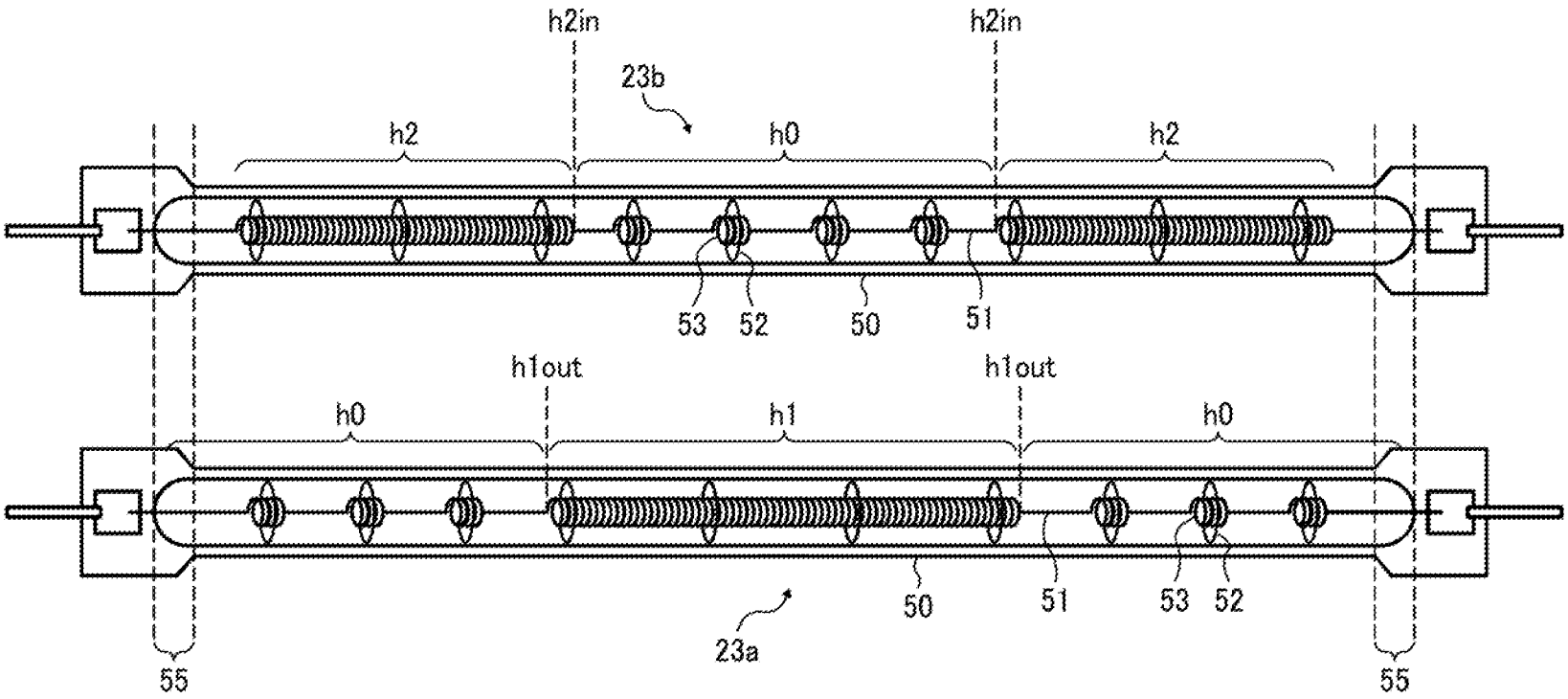
FIG. 6 is a perspective view of halogen heaters incorporated in the fixing device depicted in FIG. 2.

FIG. 6 is a perspective view of the halogen heaters 23*a* and 23*b*. As illustrated in FIG. 6, the two halogen heaters 23*a* and 23*b* have different heat generation spans in a longitudinal direction of the halogen heaters 23*a* and 23*b* parallel to the axial direction of the fixing belt 21, respectively. The halogen heater 23*a* is a center heater serving as a primary heater that includes a heat generating portion h1 (e.g., an illuminator) disposed opposite a center span of the fixing belt 21 in the axial direction thereof. The halogen heater 23*b* is a lateral end heater serving as a secondary heater that includes a heat generating portion h2 (e.g., an illuminator) disposed opposite each lateral end span of the fixing belt 21 in the axial direction thereof. An inboard edge h2in of each of the heat generating portions h2 of the halogen heater 23*b* in the longitudinal direction thereof, that corresponds to a lateral edge of the center span of the fixing belt 21 in the axial direction thereof, is disposed opposite or corresponds to each lateral edge h1out of the heat generating portion h1 of the halogen heater 23*a* in the longitudinal direction thereof. In a description below, inboard denotes a position being closer to or situated at a center of the fixing belt 21 in the axial direction thereof outboard denotes a position being closer to or situated at a lateral end of the fixing belt 21 in the axial direction thereof.

Each of the halogen heater 23*a* serving as the center heater and the halogen heater 23*b* serving as the lateral end heater includes a glass tube 50 that is tubular or cylindrical and serves as a tube and a filament 51 serving as a heat generator disposed inside the glass tube 50. The filament 51 is coiled densely and continuously in the longitudinal direction of the halogen heaters 23*a* and 23*b* to define a dense coil portion that serves as each of the heat generating portions h1 and h2 that generates heat mainly.

Conversely, the filament 51 is substantially straight to define a peripheral portion h0 that does not generate heat mainly. For example, the peripheral portion h0 generates an amount of heat that is smaller than an amount of heat generated by each of the heat generating portions h1 and h2. The peripheral portion h0 of the halogen heater 23*b* is disposed inboard from each of the heat generating portions h2 in the longitudinal direction of the halogen heater 23*b*. Each of the peripheral portions h0 of the halogen heater 23*a* is disposed outboard from the heat generating portion h1 in the longitudinal direction of the halogen heater 23*a*. A part of the filament 51 in the peripheral portion h0 is coiled densely to define a dense coil portion 53. The dense coil portion 53 is also called a dead coil and supported by a supporter 52 (e.g., a ring supporter). Since the supporter 52 supports the dense coil portion 53, the filament 51 retains a desired shape entirely. The dense coil portion 53 and the filament 51 that is straight in the peripheral portion h0 generate heat slightly. The supporter 52 is made of tungsten or the like and also situated in the heat generating portions h1 and h2.

Each of the halogen heaters 23*a* and 23*b* further includes a sealing portion 55 disposed at each lateral end of the glass tube 50 in the longitudinal direction of the halogen heaters 23*a* and 23*b*. A loop diameter of the glass tube 50 decreases at each lateral end of the glass tube 50 in a longitudinal direction thereof. Thus, the glass tube 50 narrows at the sealing portion 55, disposed at each lateral end of the glass tube 50 in the longitudinal direction thereof, to seal an interior of the glass tube 50. Alternatively, the sealing portion 55 may include an outermost end of the glass tube 50 that is coupled to a lead wire. Since a loop diameter of the sealing portion 55 is small, a mechanical strength of the sealing portion 55 is smaller than a mechanical strength of other portion of the glass tube 50. Accordingly, the sealing portion 55 is susceptible to thermal degradation and resultant breakage.

A description is provided of a configuration of a comparative fixing device.

The comparative fixing device includes a fixing belt and a heater that heats the fixing belt.

The comparative fixing device may suffer from overheating of the fixing belt and a peripheral component of the fixing belt. For example, the fixing belt may overheat in a non-conveyance span thereof where a sheet is not conveyed. Since sheets of various sizes are conveyed over the fixing belt, a width of a sheet may not equal to a heating span of the fixing belt in an axial direction thereof that is heated by the heater. If a width of a small sheet is smaller than the heating span of the fixing belt, the small sheet draws heat from a conveyance span of the fixing belt in the axial direction thereof where the small sheet is conveyed. Conversely, the small sheet does not draw heat from a non-conveyance span of the fixing belt in the axial direction thereof where the small sheet is not conveyed. Accordingly, the fixing belt may overheat in the non-conveyance span thereof that is situated at each lateral end of the fixing belt in the axial direction thereof.

A heating span of the fixing belt 21 in the axial direction thereof, which is heated by the halogen heaters 23*a* and 23*b*, changes according to a width of a sheet P in the axial direction of the fixing belt 21. If a small sheet P having a decreased width is conveyed over the fixing belt 21, the heat generating portion h1 of the halogen heater 23*a* generates heat. Conversely, if a large sheet P having an increased width is conveyed over the fixing belt 21, the heat generating portion h1 of the halogen heater 23*a* and the heat generating portions h2 of the halogen heater 23*b* generate heat.

Since sheets P of various sizes are conveyed over the fixing belt 21, the heat generating portions h2 may not address various sizes of the sheets P. Accordingly, the width of the sheet P may not equal to the heating span of the fixing belt 21 in the axial direction thereof that is heated by the halogen heaters 23*a* and 23*b*. If the width of the small sheet P is smaller than the heating span of the fixing belt 21, the small sheet P is not conveyed over a non-conveyance span of the fixing belt 21 in the axial direction thereof that is disposed at each lateral end of the fixing belt 21 in the axial direction thereof. Since the small sheet P does not draw heat from the non-conveyance span of the fixing belt 21, overheating may occur in the non-conveyance span of the fixing belt 21 and a peripheral component situated in or in proximity to the non-conveyance span of the fixing belt 21.

The comparative fixing device may include a reflector that reflects light or heat radiated from the heater to the fixing belt, thus reducing redundant heat generation of the heater and heating the fixing belt effectively.

However, heat reflected by the reflector may overheat the peripheral component of the fixing belt. For example, heat reflected by the reflector heats the peripheral component of the fixing belt that is disposed outboard from the heating span of the fixing belt. The peripheral component of the fixing belt is heated by heat reflected by the reflector in addition to heat radiated from the heater directly, thus suffering from overheating. Accordingly, the overheated peripheral component of the fixing belt may be degraded or broken.

As illustrated in FIG. 2, the fixing device 20 includes the reflector 26 that reflects heat radiated from the halogen heaters 23*a* and 23*b* toward the fixing belt 21 so that the fixing belt 21 is heated effectively by heat reflected by the reflector 26 in addition to heat conducted from the halogen heaters 23*a* and 23*b* directly. Accordingly, the fixing belt 21 and the peripheral component of the fixing belt 21 are susceptible to temperature increase with heat reflected by the reflector 26 in addition to heat conducted from the halogen heaters 23*a* and 23*b* directly.

As heat radiated from the halogen heaters 23*a* and 23*b* and heat reflected by the reflector 26 are conducted to each lateral end of the fixing belt 21 in the axial direction thereof, the peripheral component situated in proximity to each lateral end of the fixing belt 21 may overheat and suffer from thermal degradation and breakage over time.

As illustrated in FIG. 2, the reflector 26 is bent toward the halogen heaters 23*a* and 23*b* such that the reflector 26 covers the halogen heaters 23*a* and 23*b* in the circumferential direction of the fixing belt 21. Accordingly, the reflector 26 directs and concentrates heat radiated from the heat generating portion h1 of the halogen heater 23*a* and the heat generating portions h2 of the halogen heater 23*b* to a narrow region of the fixing belt 21, thus reflecting heat toward the fixing belt 21 effectively. However, the reflector 26 includes a plurality of bent faces that reflects heat irregularly and diffuses heat when heat reaches the reflector 26. The diffused heat may heat or overheat the peripheral component disposed outboard from the heating span of the fixing belt 21 that is heated by the heat generating portions h1 and h2 in the axial direction of the fixing belt 21.

To address those circumstances, the fixing device 20 according to this exemplary embodiment has a positional relation between the reflector 26 and the peripheral component of the fixing belt 21, which protects the peripheral component of the fixing belt 21 against heat reflected by the reflector 26.

Figure 7:
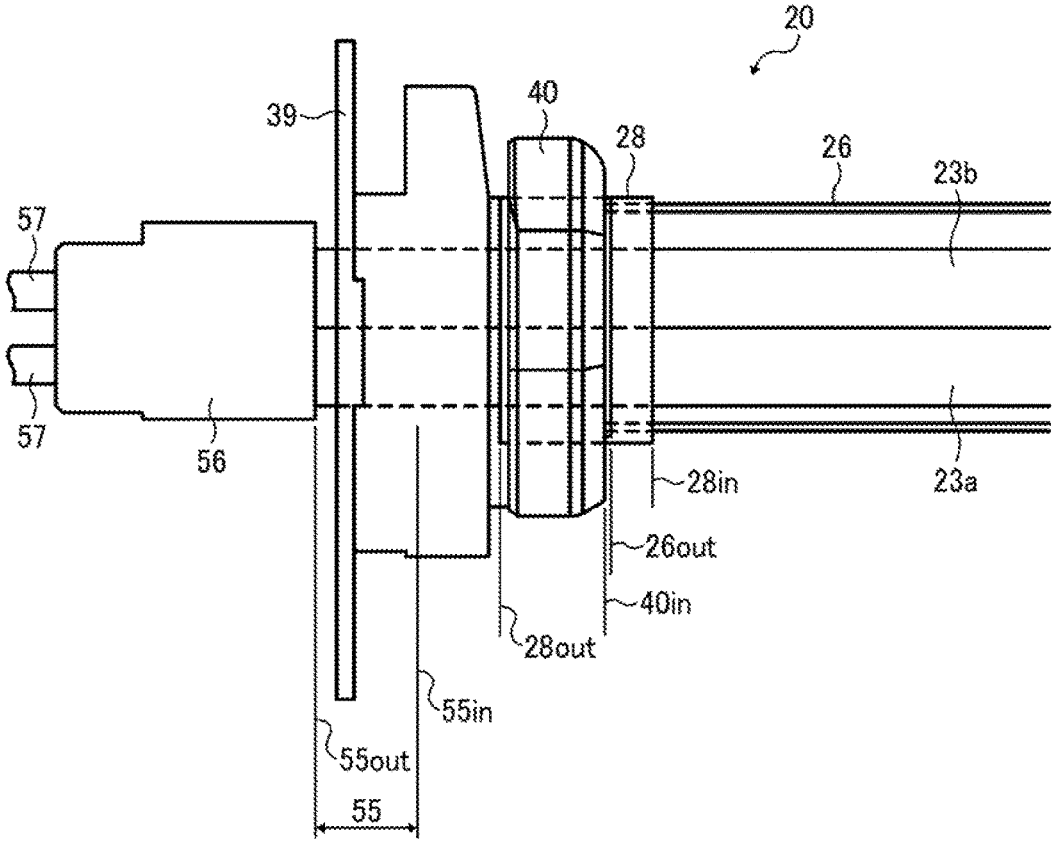
FIG. 7 is a partial side view of the fixing device depicted in FIG. 3.

Referring to FIG. 7, a description is provided of arrangement of the reflector 26 and peripheral components of the fixing belt 21.

FIG. 7 is a partial side view of the fixing device 20, schematically illustrating a positional relation between the reflector 26 and the peripheral components of the fixing belt 21 in the axial direction thereof. In FIG. 7, the peripheral components of the fixing belt 21 are simplified. A description of a construction that restricts a position of the halogen heaters 23*a* and 23*b* in the longitudinal direction thereof is deferred with reference to FIG. 8.

As illustrated in FIG. 7, the belt holder 40, the stationary shield 28, and other components of the fixing device 20 are disposed opposite each lateral end (e.g., an outboard end) of the fixing belt 21 in the axial direction thereof. In order to reflect radiant heat radiated from the halogen heaters 23*a* and 23*b* toward the fixing belt 21 to heat the fixing belt 21 effectively, the reflector 26 is disposed opposite the halogen heaters 23*a* and 23*b* and spans from each lateral end to the center of the fixing belt 21 in the axial direction thereof.

A connector 56 is disposed outboard from the sealing portion 55 of each of the two halogen heaters 23*a* and 23*b* in the longitudinal direction thereof. The connector 56 supports each lateral end of each of the halogen heaters 23*a* and 23*b* in the longitudinal direction thereof. A lead wire 57 is coupled to the connector 56 and extended outward from the connector 56 in the longitudinal direction of the halogen heaters 23*a* and 23*b*. A diameter of the connector 56 is greater than a diameter of the halogen heaters 23*a* and 23*b*. The two halogen heaters 23*a* and 23*b* are supported by an interior of the connector 56.

According to this exemplary embodiment, an inboard edge 55in of the sealing portion 55 of each of the halogen heaters 23*a* and 23*b* is disposed outboard from an outboard edge 26out of the reflector 26 in the longitudinal direction of the halogen heaters 23*a* and 23*b*. Accordingly, heat or light reflected by the reflector 26 does not reach or barely reaches the sealing portion 55. As described above, the mechanical strength of the sealing portion 55 is smaller than the mechanical strength of other portion of the glass tube 50. As the sealing portion 55 is heated to a high temperature repeatedly by heat reflected by the reflector 26, the sealing portion 55 may be broken over time. To address this circumstance, the sealing portion 55 is disposed outboard from the reflector 26 in the longitudinal direction of the halogen heaters 23*a* and 23*b* so that the sealing portion 55 does not overheat. Accordingly, the sealing portion 55 is protected against thermal degradation and the glass tube 50 defining the sealing portion 55 is immune from breakage such as crack.

An inboard edge 40in of the belt holder 40 is disposed outboard from the outboard edge 26out of the reflector 26 in the longitudinal direction of the halogen heaters 23*a* and 23*b*. Accordingly, heat or light reflected by the reflector 26 does not reach or barely reaches the belt holder 40 or the stationary shield 28 disposed opposite the belt holder 40.

As illustrated in FIG. 7, an inboard edge 28in of the stationary shield 28 is disposed inboard from the outboard edge 26out of the reflector 26 in the longitudinal direction of the halogen heaters 23*a* and 23*b*. An outboard edge 28out of the stationary shield 28 is disposed outboard from the outboard edge 26out of the reflector 26 in the longitudinal direction of the halogen heaters 23*a* and 23*b*. An outboard edge 55out of the sealing portion 55 is disposed inboard from the connector 56 in the longitudinal direction of the halogen heaters 23*a* and 23*b*.

A belt holder of the comparative fixing device may be made of a heat resistant material (e.g., metal) to prevent the belt holder from being adversely affected by heat or light reflected by a reflector. Conversely, according to this exemplary embodiment, the belt holder 40 or the stationary shield 28 that protects the belt holder 40 is not susceptible to heat or light reflected by the reflector 26. Hence, the belt holder 40 may be made of resin (e.g., resin having a reduced heat resistance). Thus, the belt holder 40 is made of a material selected from a wide variety of materials, reducing manufacturing costs. If the belt holder 40 is made of a rigid material such as metal, the belt holder 40 may cause abrasion or the like of the fixing belt 21. To address this circumstance, the belt holder 40 is made of resin, preventing abrasion of the fixing belt 21.

A description is provided of a construction of a restraint 58 incorporated in the fixing device 20.

Figure 8:
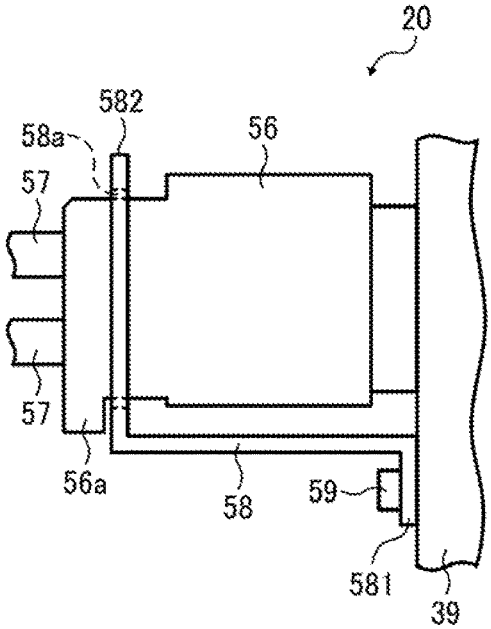
FIG. 8 is a partial side view of the fixing device depicted in FIG. 7, illustrating a restraint incorporated therein.

FIG. 8 is a partial side view of the fixing device 20, illustrating the restraint 58 disposed at one lateral end of the fixing device 20 in the longitudinal direction thereof. For example, the restraint 58 is coupled to one lateral end of the halogen heaters 23*a* and 23*b* in the longitudinal direction thereof to restrict motion of the halogen heaters 23*a* and 23*b* in the longitudinal direction thereof.

As illustrated in FIG. 8, the restraint 58 includes a mounted portion 581 mounted on an outer face of the side plate 39 that is opposite an inner face of the side plate 39 that mounts the mounted portion 403 of the belt holder 40 depicted in FIG. 4. The mounted portion 581 is secured to the side plate 39 with a fastener 59 such as a screw. The restraint 58 further includes a restricting portion 582 disposed outboard from the mounted portion 581 in the longitudinal direction of the halogen heaters 23*a* and 23*b*. The restricting portion 582 includes a through hole 58*a*.

The connector 56 is inserted into the through hole 58*a* of the restraint 58. The connector 56 includes a rib 56*a* disposed outboard from the restricting portion 582 in the longitudinal direction of the halogen heaters 23*a* and 23*b*. The rib 56*a* projects in a radial direction of the halogen heaters 23*a* and 23*b*. The rib 56*a* projects beyond the through hole 58*a* in the radial direction of the halogen heaters 23*a* and 23*b*. As the connector 56 moves rightward in FIG. 8 relative to the restraint 58, the rib 56*a* comes into contact with the restricting portion 582 of the restraint 58. As the rib 56*a* contacts the restraint 58, the restraint 58 restricts motion of the connector 56 rightward in FIG. 8, that is, inward in the longitudinal direction of the halogen heaters 23*a* and 23*b* or the axial direction of the fixing belt 21. Thus, the restraint 58 restricts a position of the halogen heaters 23*a* and 23*b* relative to the restraint 58 and the side plate 39 in the longitudinal direction of the halogen heaters 23*a* and 23*b*.

The restraint 58 supports the connector 56 also at another lateral end of the fixing device 20 in the longitudinal direction thereof. However, the connector 56 disposed at another lateral end of the fixing device 20 in the longitudinal direction thereof does not incorporate the rib 56*a*. Hence, the restraint 58 does not restrict the position of the connector 56 disposed at another lateral end of the fixing device 20 in the longitudinal direction thereof.

If the restraint 58 restricts the position of the halogen heaters 23*a* and 23*b* at each lateral end of the halogen heaters 23*a* and 23*b* in the longitudinal direction thereof, when the connector 56 and the halogen heaters 23*a* and 23*b* expand thermally due to heat generation or the like of the halogen heaters 23*a* and 23*b*, thermal expansion of the connector 56 and the halogen heaters 23*a* and 23*b* is not absorbed, resulting in breakage of parts of the fixing device 20.

To address this circumstance, according to this exemplary embodiment, the rib 56*a* is disposed at one of the connectors 56 that is disposed at one lateral end of the halogen heaters 23*a* and 23*b* in the longitudinal direction thereof to restrict the position of the halogen heaters 23*a* and 23*b* in the longitudinal direction thereof. Accordingly, even if the connector 56 and the halogen heaters 23*a* and 23*b* expand thermally, thermal expansion of the connector 56 and the halogen heaters 23*a* and 23*b* is absorbed at another lateral end of the halogen heaters 23*a* and 23*b* in the longitudinal direction thereof, preventing breakage of parts of the fixing device 20. The restraint 58 restricts the position of the halogen heaters 23*a* and 23*b* at one lateral end of the halogen heaters 23*a* and 23*b* in the longitudinal direction thereof and allows the halogen heaters 23*a* and 23*b* that thermally expand to elongate at another lateral end of the halogen heaters 23*a* and 23*b* in the longitudinal direction thereof.

A positional relation between the halogen heaters 23*a* and 23*b* and the peripheral components of the fixing belt 21, that is seen from one lateral end of the halogen heaters 23*a* and 23*b* in the longitudinal direction thereof does not deviate or barely deviates due to thermal expansion of the connector 56 and the halogen heaters 23*a* and 23*b*. Thus, the positional relation among the sealing portion 55, the belt holder 40, and the reflector 26 depicted in FIG. 7 is retained.

A description is provided of a variation of the halogen heater 23*a*.

Figure 9:
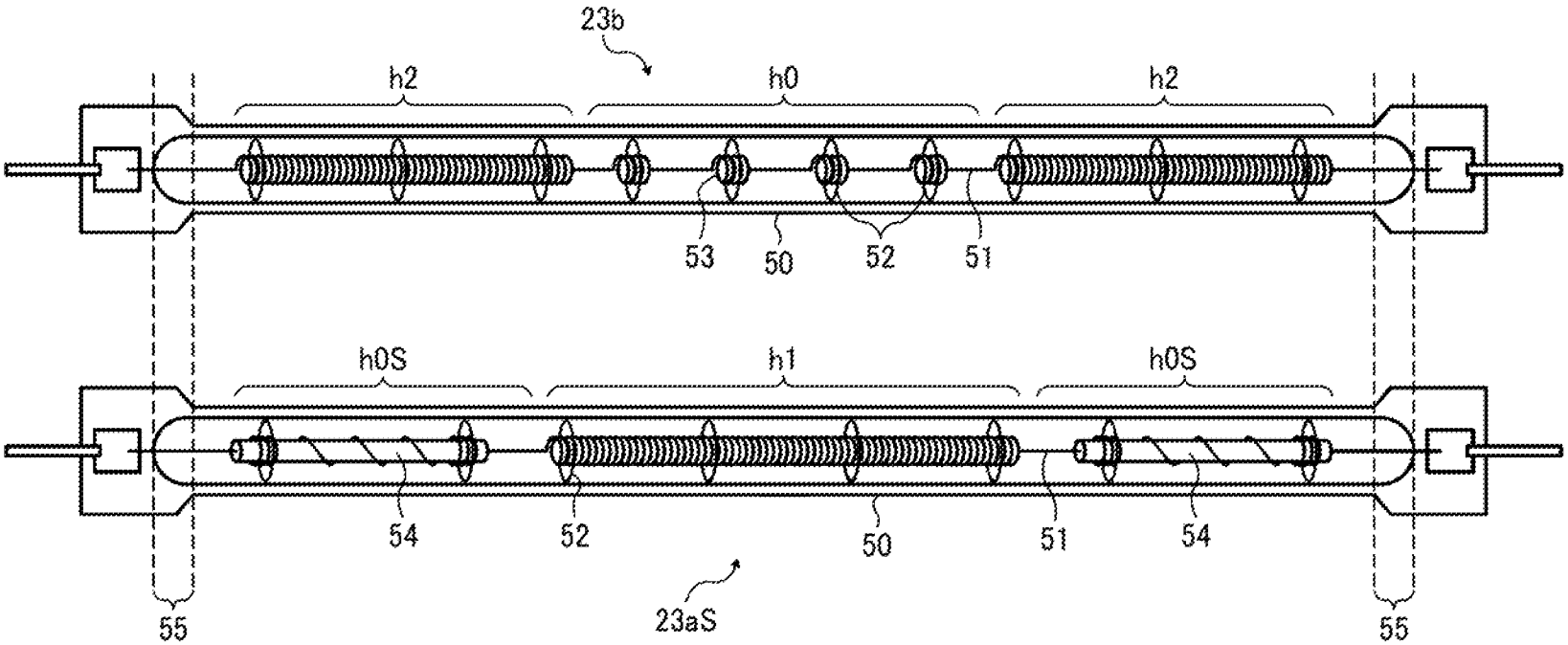
FIG. 9 is a perspective view of halogen heaters as a variation of the halogen heaters depicted in FIG. 6.

FIG. 9 is a perspective view of the halogen heater 23*b* and a halogen heater 23*a*S as the variation of the halogen heater 23*a* depicted in FIG. 6. As illustrated in FIG. 9, the halogen heater 23*a*S is a center heater that heats the center span of the fixing belt 21 in the axial direction thereof. The halogen heater 23*a*S includes the heat generating portion h1 and two peripheral portions h0S. Like the heat generating portion h1 of the halogen heater 23*a* depicted in FIG. 6, the heat generating portion h1 of the halogen heater 23*a*S is disposed at a center span of the halogen heater 23*a*S in a longitudinal direction thereof. The peripheral portions h0S of the halogen heater 23*a*S are disposed outboard from the heat generating portion h1 in the longitudinal direction of the halogen heater 23*a*S. Unlike the peripheral portion h0 of the halogen heater 23*a* depicted in FIG. 6, the peripheral portion h0S includes a core bar 54 for short-circuiting, that serves as a core. The filament 51 is coiled around the core bar 54. The core bar 54 for short-circuiting is made of a material having a reduced electric resistance, such as molybdenum. An electric resistance of the core bar 54 is smaller than an electric resistance of the filament 51. Since the filament 51 is wound around the core bar 54 extending in the longitudinal direction of the halogen heater 23*a*S, the filament 51 retains a desired shape inside the glass tube 50.

Since the peripheral portion h0S includes the core bar 54, compared to the peripheral portion h0 of the halogen heater 23*a* that includes the dense coil portion 53 as illustrated in FIG. 6, the peripheral portion h0S as a whole decreases electric resistance, suppressing heat generation from the peripheral portion h0S. Accordingly, the peripheral portion h0S suppresses overheating or temperature increase of the fixing belt 21 and the peripheral components that are disposed at each lateral end of the fixing belt 21 in the axial direction thereof. Thus, with the positional relation among the sealing portion 55, the belt holder 40, and the reflector 26 depicted in FIG. 7, the peripheral portion h0S prevents overheating of the sealing portion 55 of the glass tube 50 and the belt holder 40 precisely.

Figure 10:
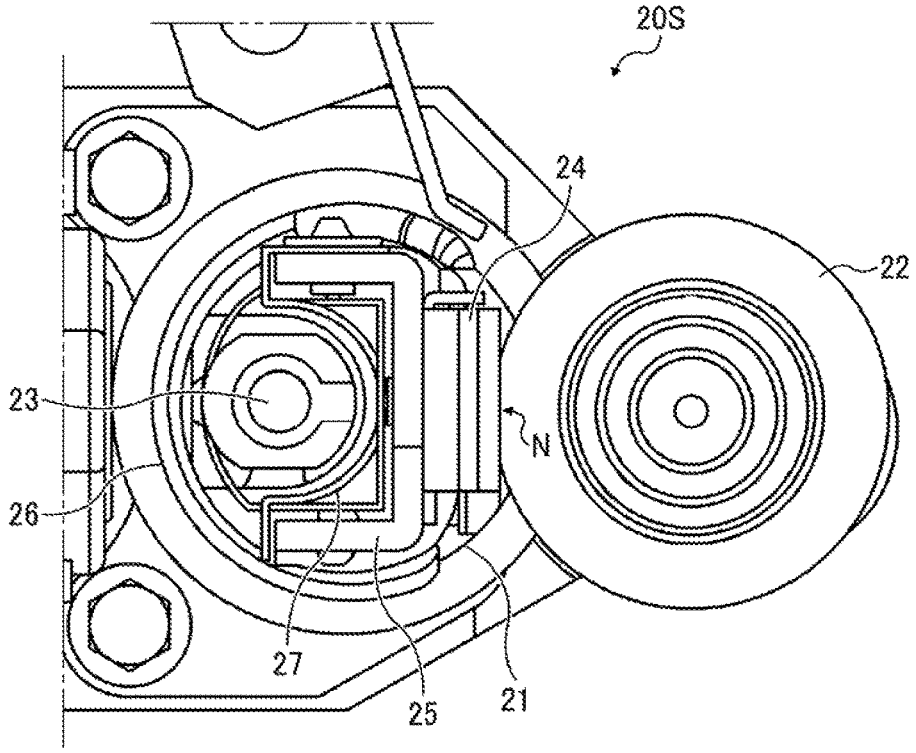
FIG. 10 is a schematic vertical cross-sectional view of a fixing device according to a second exemplary embodiment.
Figure 11:
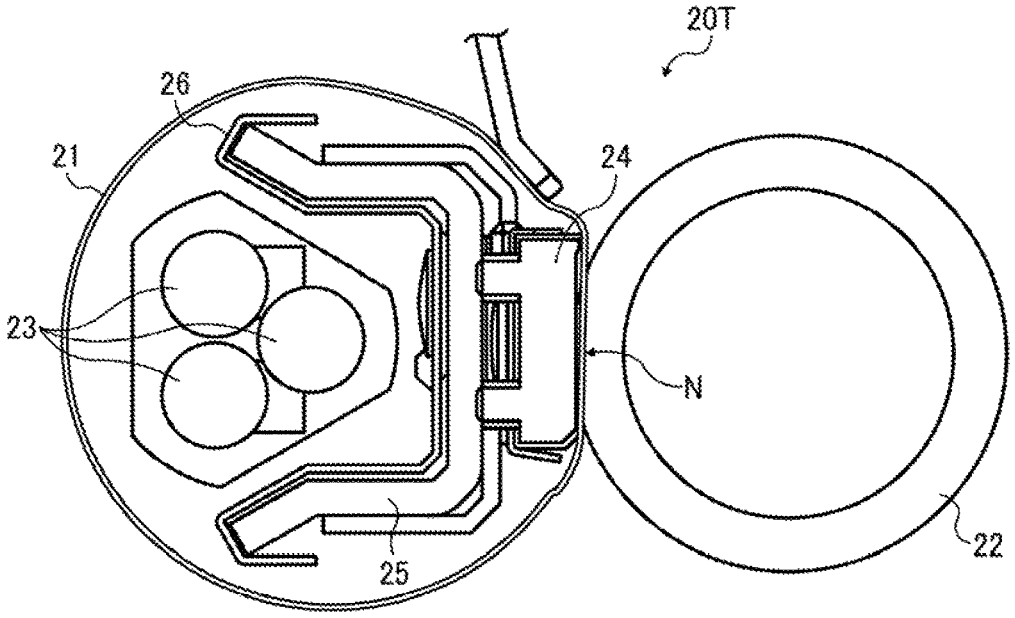
FIG. 11 is a schematic vertical cross-sectional view of a fixing device according to a third exemplary embodiment.

As illustrated in FIG. 2, the fixing device 20 includes the two halogen heaters 23*a* and 23*b*. Alternatively, the exemplary embodiments described above may be applied to a fixing device 20S incorporating a single halogen heater 23 as illustrated in FIG. 10. FIG. 10 is a schematic vertical cross-sectional view of the fixing device 20S. Yet alternatively, the exemplary embodiments described above may be applied to a fixing device 20T incorporating three or more halogen heaters 23 according to the sizes or the like of the sheets P that are available in the image forming apparatus 1 as illustrated in FIG. 11. FIG. 11 is a schematic vertical cross-sectional view of the fixing device 20T. Each of the fixing devices 20S and 20T has the positional relation between the reflector 26 and at least one of the sealing portion 55 and the belt holder 40 as described above, thus attaining advantages of the exemplary embodiments described above.

The present disclosure is not limited to the details of the exemplary embodiments described above and various modifications and improvements are possible.

A description is provided of advantages of the fixing devices 20, 20S, and 20T.

As illustrated in FIGS. 2, 10, and 11, a fixing device (e.g., the fixing devices 20, 20S, and 20T) includes a fixing rotator (e.g., the fixing belt 21), a heater (e.g., the halogen heaters 23*a*, 23*a*S, and 23), and a reflector (e.g., the reflector 26). The fixing rotator is rotatable in a rotation direction (e.g., the rotation direction D21). The heater is disposed opposite the fixing rotator and heats the fixing rotator. The reflector is disposed opposite the heater and reflects heat radiated from the heater toward the fixing rotator.

As illustrated in FIGS. 6 and 9, the heater includes a heat generating portion (e.g., the heat generating portion h1) disposed inside a tube (e.g., the glass tube 50). A sealing portion (e.g., the sealing portion 55) is disposed at each lateral end of the tube in a longitudinal direction thereof. The sealing portion seals the tube. An inboard denotes a position being closer to or situated at a center of the fixing rotator in an axial direction thereof; outboard denotes a position being closer to or situated at a lateral end of the fixing rotator in the axial direction thereof.

As illustrated in FIG. 7, an inboard edge (e.g., the inboard edge 55in) of the sealing portion is disposed outboard from an outboard edge (e.g., the outboard edge 26out) of the reflector in the axial direction of the fixing rotator.

Accordingly, the sealing portion is not overheated by heat radiated from the heater and reflected by the reflector, thus being immune from degradation and breakage.

The fixing device 20 employs a center conveyance system in which the sheet P is centered on the fixing belt 21 in the axial direction thereof. Alternatively, the fixing device 20 may employ a lateral end conveyance system in which the sheet P is conveyed in the sheet conveyance direction DP along one lateral end of the fixing belt 21 in the axial direction thereof. In this case, one of the peripheral portions h0 of the halogen heater 23*a* and one of the heat generating portions h2 of the halogen heater 23*b* depicted in FIG. 6 are eliminated. Another one of the peripheral portions h0 of the halogen heater 23*a* and another one of the heat generating portions h2 of the halogen heater 23*b* are distal from the one lateral end of the fixing belt 21 in the axial direction thereof.

According to the exemplary embodiments described above, the fixing belt 21 serves as a fixing rotator. Alternatively, fixing roller, a fixing film, a fixing sleeve, or the like may be used as a fixing rotator. Further, the pressure roller 22 serves as an opposed rotator. Alternatively, a pressure belt or the like may be used as an opposed rotator.

The above-described embodiments are illustrative and do not limit the present disclosure. Thus, numerous additional modifications and variations are possible in light of the above teachings. For example, elements and features of different illustrative embodiments may be combined with each other and substituted for each other within the scope of the present invention.

Any one of the above-described operations may be performed in various other ways, for example, in an order different from the one described above.

What is claimed is:

1. A fixing device comprising:

a fixing rotator being rotatable;

a heater to heat the fixing rotator, the heater including:

a tube;

means for heating, disposed inside the tube, to generate heat; and means for sealing, disposed at each lateral end of the tube in a longitudinal direction of the heater, to seal the tube;

a reflector to reflect heat radiated from the heater toward the fixing rotator, the reflector including an outboard edge being disposed inboard from at least a part of the means for sealing in an axial direction of the fixing rotator;

a holder that rotatably supports the fixing rotator; and a shield, disposed opposite a lateral end of the fixing rotator in the axial direction of the fixing rotator, and interposed between the fixing rotator and the heater, wherein at least a part of the means for sealing is disposed outboard from an outboard edge of the shield in the axial direction of the fixing rotator, and the holder includes an inboard edge being disposed outboard from the outboard edge of the reflector in the axial direction of the fixing rotator.

2. The fixing device according to claim 1, wherein the holder is made of resin.

3. The fixing device according to claim 1, wherein the means for heating includes:

a heat generating portion to generate a first amount of heat; and a peripheral portion, disposed outboard from the heat generating portion in the longitudinal direction of the heater, to generate a second amount of heat that is smaller than the first amount of heat generated by the heat generating portion.

4. The fixing device according to claim 3, wherein the heat generating portion is disposed opposite a center span of the fixing rotator in the axial direction of the fixing rotator, and wherein the peripheral portion is disposed opposite each lateral end span of the fixing rotator in the axial direction of the fixing rotator.

5. The fixing device according to claim 3, wherein the means for heating includes a filament.

* * * * *